US009919178B2

(12) United States Patent
Morton

(10) Patent No.: US 9,919,178 B2
(45) Date of Patent: Mar. 20, 2018

(54) APPARATUS FOR EXERCISING A PERSON'S CALVES IN TWO DIFFERENT WAYS

(71) Applicant: Lee Robert Morton, Seven Oaks (GB)

(72) Inventor: Lee Robert Morton, Seven Oaks (GB)

( * ) Notice: Subject to any disclaimer, the term of this patent is extended or adjusted under 35 U.S.C. 154(b) by 0 days.

(21) Appl. No.: 14/757,241

(22) Filed: Dec. 10, 2015

(65) Prior Publication Data

US 2017/0165517 A1 Jun. 15, 2017

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/035*** | (2006.01) |
| ***A63B 23/08*** | (2006.01) |
| ***A63B 69/00*** | (2006.01) |

(52) U.S. Cl.

CPC ..... *A63B 21/0552* (2013.01); *A63B 21/0442* (2013.01); *A63B 21/4034* (2015.10);

(Continued)

(58) Field of Classification Search

CPC ..... A63B 21/0004; A63B 21/00043; A63B 21/00058; A63B 21/00061; A63B 21/00065; A63B 21/00069; A63B 21/00178; A63B 21/00185; A63B 21/002; A63B 21/0023; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/08; A63B 21/15; A63B 21/151; A63B 21/22; A63B 21/4011; A63B 21/4015; A63B 21/4023; A63B 21/4025; A63B 21/4027; A63B 21/4033; A63B 21/4034; A63B 21/4039; A63B 21/4045; A63B 21/4047;

(Continued)

(56) References Cited

U.S. PATENT DOCUMENTS 3,204,955 A * 9/1965 Quire ..... A63B 21/0004 482/91
4,090,706 A * 5/1978 Reda ..... A63B 21/0004 482/122

(Continued)

FOREIGN PATENT DOCUMENTS

GB 2414420 A * 11/2005 ..... A63B 23/08
GB 2484975 A * 5/2012 ..... A63B 21/028
GB 2505996 A * 3/2014 ..... A63B 21/4023

*Primary Examiner* — Loan H Thanh
*Assistant Examiner* — Gary D Urbiel Goldner

(57) ABSTRACT

An apparatus for exercising a person's calves in two different ways. The apparatus comprising a footrest, a kneerest, and a length of stretchable material for extending between the footrest and the kneerest. The length of stretchable material is flat sided and the footrest has a roller arrangement that allows the length of stretchable material to connect to the footrest such that the flat sides of the length of stretchable material slide over the roller arrangement. The kneerest has an anchor means for the length of stretchable material that allows the length of stretchable material to connect to the kneerest such that the flat sides of the length of stretchable material pass over the anchor means. The footrest, the kneerest, and the length of stretchable material are separable from each other.

13 Claims, 14 Drawing Sheets

(52) U.S. Cl.
CPC .... *A63B 21/4047* (2015.10); *A63B 23/03525* (2013.01); *A63B 23/08* (2013.01); *A63B 21/4035* (2015.10); *A63B 2069/0062* (2013.01); *A63B 2208/0204* (2013.01); *A63B 2208/0233* (2013.01); *A63B 2210/50* (2013.01); *A63B 2225/093* (2013.01)

(58) Field of Classification Search
CPC ..... A63B 21/4049; A63B 23/035; A63B 23/03516; A63B 23/03525; A63B 23/04; A63B 23/0405; A63B 23/0482; A63B 23/0494; A63B 23/08; A63B 23/085; A63B 23/10; A63B 69/0057; A63B 69/0059; A63B 2069/0062; A63B 2208/02; A63B 2208/0204; A63B 2208/0209; A63B 2208/0228; A63B 2208/0233; A63B 2210/50; A63B 2210/52; A63B 2225/09; A63B 2225/093
See application file for complete search history.

(56) References Cited

U.S. PATENT DOCUMENTS 4,195,835 A * 4/1980 Hinds ..... A63B 21/0552 482/125
5,125,649 A * 6/1992 Fuller ..... A63B 21/0004 482/106
5,433,684 A * 7/1995 Carrillo ..... A63B 23/085 482/123
5,624,360 A * 4/1997 Wilkins ..... A63B 21/1645 482/121
5,674,163 A * 10/1997 Sennett ..... A63B 23/0216 482/125
5,700,232 A * 12/1997 Clausen ..... A63B 21/0552 482/125
5,945,060 A * 8/1999 Williams ..... A63B 21/0004 264/150
6,022,297 A * 2/2000 DeJesus ..... A63B 23/0494 482/70
6,063,010 A * 5/2000 Howd ..... A63B 21/0004 482/121
6,210,303 B1 * 4/2001 Miller ..... A63B 21/002 482/45
6,220,994 B1 * 4/2001 Rich ..... A63B 21/0004 482/123
6,558,301 B1 * 5/2003 Jackson ..... A63B 21/0552 482/121
9,339,693 B1 * 5/2016 Pegram, II ..... A63B 26/00
9,403,049 B2 * 8/2016 Harada ..... A63B 21/028
2002/0193210 A1 * 12/2002 Turner ..... A63B 21/4047 482/80
2009/0192022 A1 * 7/2009 Kulka ..... A63B 21/153 482/46
2015/0045193 A1 * 2/2015 Morton ..... A63B 21/0552 482/123
2015/0196789 A1 * 7/2015 Whitt ..... A63B 21/00185 482/124
2016/0279012 A1 * 9/2016 Hurtado ..... A61H 1/0266

* cited by examiner 8
42
38
36
40

8
42
40

8
40

8
42
36
38
40

8
32
34
39
30
41
14

8
30
35
37
39
37
14
41

APPARATUS FOR EXERCISING A PERSON'S CALVES IN TWO DIFFERENT WAYS

This invention relates to exercise apparatus and, more especially, this invention relates to apparatus for exercising a person's calves in two different ways.

Known apparatus for use in exercising a person's calves is mainly in the form of machines which are constructed for use in gymnasiums. There is very little known apparatus which is marketed for home use. Furthermore, the apparatus which is marketed for home use has an attached seat which increases the cost of the apparatus and also the area required for storage of the apparatus.

In my UK Patent Nos. GB2484975 and GB2505996, I have disclosed apparatus for exercising a person's calves which obviate or reduce the above mentioned problems. It is an aim of the present invention to provide further apparatus which has the advantages of the apparatus in my two patents, but which is also able to exercise a person's calves in two different ways.

Accordingly, the present invention provides an apparatus for exercising a person's calves in two different ways, which apparatus comprises a footrest, a kneerest, and a length of stretchable material for extending between the footrest and the kneerest, and the apparatus being such that:

(i) the length of stretchable material is flat sided;

(ii) the footrest has a roller arrangement;

(iii) the roller arrangement allows the length of stretchable material to connect to the footrest such that the flat sides of the length of stretchable material slide over the roller arrangement;

(iv) the kneerest has anchor means for the length of stretchable material;

(v) the anchor means allows the length of stretchable material to connect to the kneerest such that the flat sides of the length of stretchable material pass over the anchor means;

(vi) the anchor means comprises a rod portion which extends parallel to the knee rest, which is spaced apart from the knee rest, and around which the length of stretchable material passes without deformation along a longitudinal axis of the length of stretchable material during use of the apparatus with the person in the seated position;

(vii) the length of stretchable material has a first free end and a second free end;

(viii) the footrest, the kneerest, and the length of stretchable material are separable from each other;

(ix) the footrest, the kneerest and the length of stretchable material are configurable such that in use together and with the person seated in the seated position, the first and second free ends are held solely by the person over an upper face of the kneerest in order to secure the first and second free ends with respect to the kneerest;

(x) the footrest, the kneerest and the length of stretchable material are configurable such that in use together and with the person seated in a seated position and holding the first and second free ends on the upper face of the kneerest, then the front part of the person's feet rests on the footrest to retain the footrest on a floor, the kneerest rests on the person's knees, the length of stretchable material is stretched when the person pivots a rear part of their feet upwardly with the respect to the footrest, the length of stretchable material contracts when the person pivots the rear part of their feet downwardly with respect to the footrest, and the stretching of the length of stretchable material requires effort from the person's calves which thereby exercises the person's calves with the person being in the seated position; and (xi) the footrest and the length of stretchable material are configurable such that in use together and without the kneerest and with the person in a standing position and holding the first and second free ends of the length of stretchable material, then the front part of the person's feet rests on the footrest to retain the footrest on the floor, the length of the stretchable material is stretched when the person pivots the rear part of their feet upwardly with respect to the footrest, and the stretching of the length of material requires effort from the person's calves which thereby exercises the person's calves.

The apparatus of the present invention is advantageous in that it is able to be marketed for home use, it does not require an attached seat, and it is easily able to be altered for use of the apparatus with the person standing or sitting.

The apparatus may be one in which the roller means is positioned on the underside of the footrest. The roller means may be positioned elsewhere on the footrest if desired.

Preferably the roller means is a pair of spaced apart rollers. The rollers may be needle-bearing rollers or ball bearing rollers. Other types of roller means may be employed.

Preferably, the footrest has a pair of spaced apart apertures for locating the length of stretchable material. Other formations may be employed for locating the length of stretchable material so that, for example, the footrest may comprise a pair of spaced apart recesses for locating the length of stretchable material.

The apparatus may be one in which the footrest has a pair of spaced apart foot pads for receiving the person's feet, and in which the foot pads has a slip-resisting surface for preventing the person's feet slipping off the footrest. Other constructions may be employed so that, for example, the footrest could have a single planar surface rather than the spaced apart foot pads, and the single planar surface could be slip-resisting or not.

Preferably, the apparatus is one in which the kneerest has an aperture for locating the length of stretchable material. Other constructions may be employed so that, for example, the kneerest may have a recess for locating the length of stretchable material.

The kneerest may comprise a pair of knee pads for providing comfort to the knees of the person when using the apparatus in the seated position. Other constructions may be employed so that, for example, the knee pads may be omitted, or combined into a single larger knee pad for both knees.

If desired, the anchor means may comprise an end abutment member for use in preventing the length of stretchable material slipping off the apparatus during use of the apparatus with the person in the seated position. Any suitable and appropriate type of end abutment member may be employed. Thus, for example, the end abutment member may be a nut, a pin or other formation. The nut or other formation may screw onto a threaded end of the rod portion, or otherwise fix to the end of the rod portion.

The length of stretchable material may have a surface texture that is not slippery and may feel tacky. Such non-slippery material is still able to slide easily with respect to the footrest due to the use of the roller means over which the length of stretchable material passes.

Preferably, the length of stretchable material is of such a length that it is folded in two when the apparatus is used with the person in the standing position, and is folded in four when the apparatus is used with the person in the seated position. When the length of stretchable material is folded in four, it will provide double the resistance as compared with when the length of stretchable material is folded in two.

The apparatus of the present invention may include more than one, for example two, of the lengths of stretchable material for increasing the required effort from the person's calves.

Embodiments of the invention will now be described solely by way of example and with reference to the accompanying drawings in which.

Figure 1:
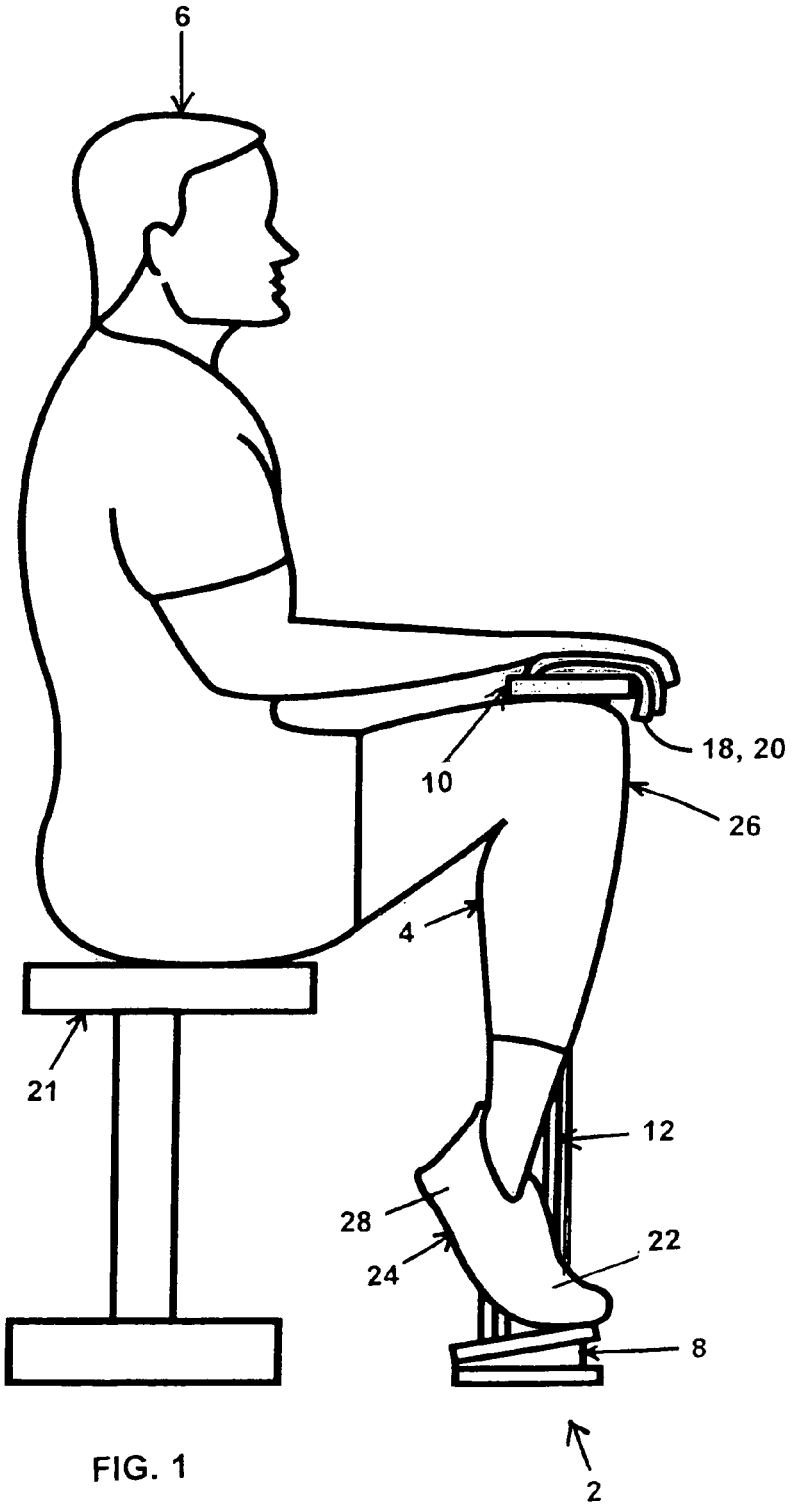
FIG. 1 shows apparatus of the present invention being used to exercise a person's calves with the person being in a seated position.

Referring to FIGS. 1-19, there is shown apparatus 2 for exercising the calves 4 of a person 6. The apparatus 2 comprises a footrest 8, a kneerest 10 and a length of stretchable material 12.

The apparatus 2 is such that the length of stretchable material 12 is flat-sided. This is best shown in FIG. 3 where it will be seen that the length of stretchable material 12 is of narrow rectangular cross-sectional shape.

Figure 13:
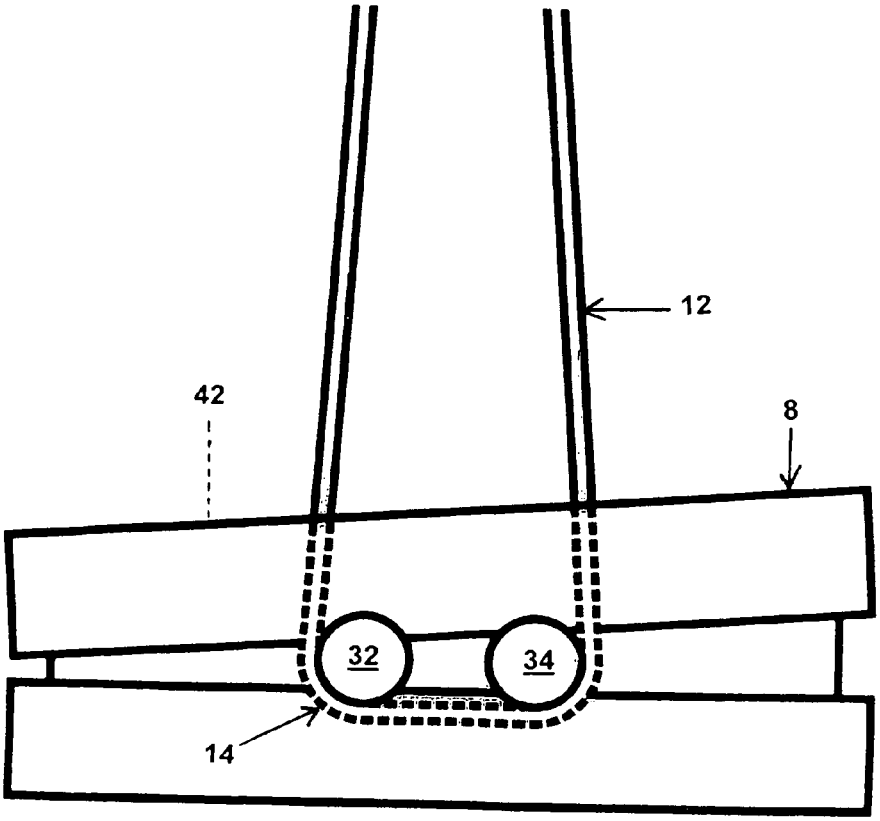
FIG. 13 is an enlarged end view of the apparatus as shown in FIG. 12.
Figures 14, 15, 16, 17, 18, 19:
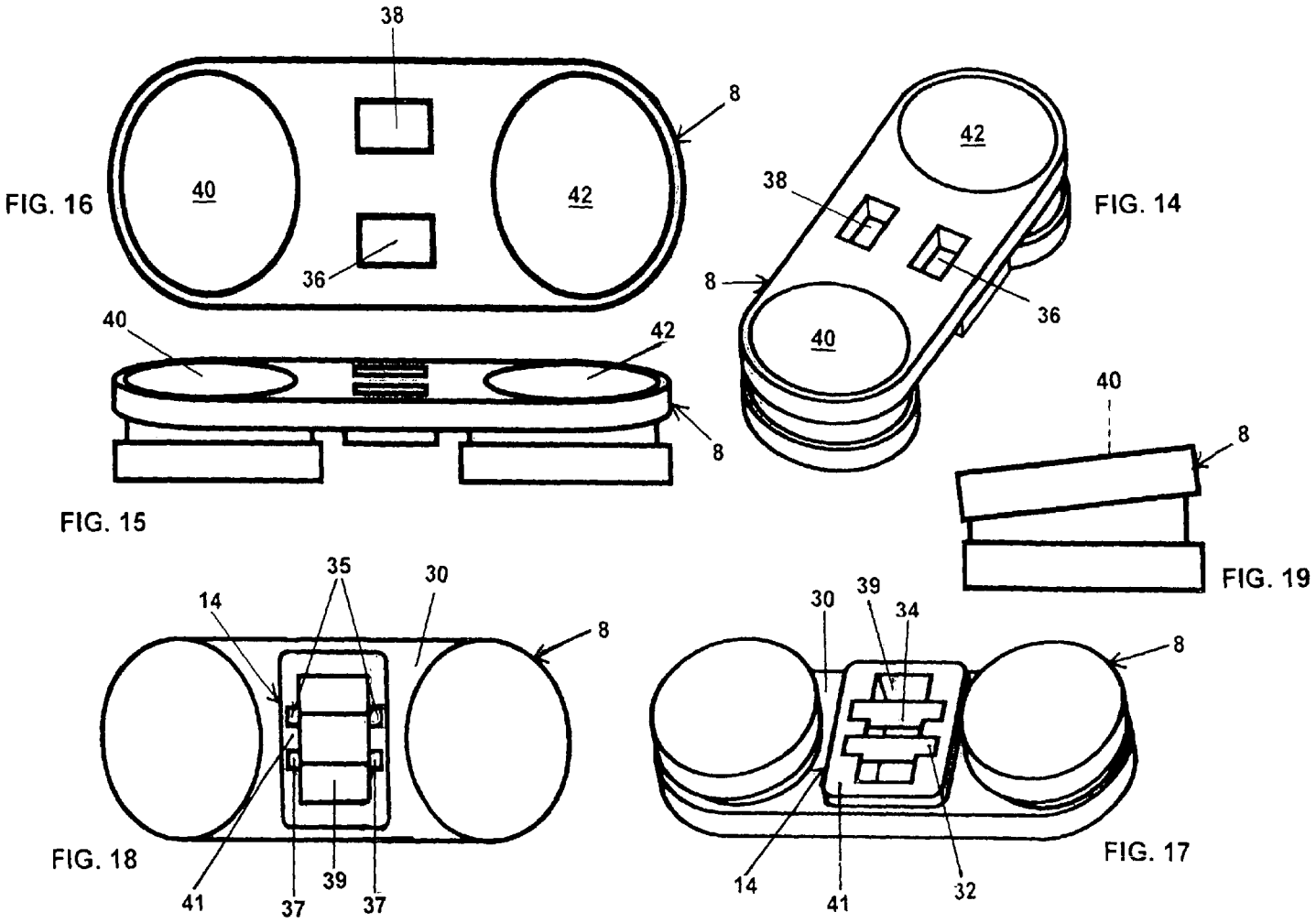
FIG. 14 is a view from above and one side of the footrest used in the apparatus in its mode of use in both FIGS. 1 and 2.
FIG. 15 is a front view of the apparatus as shown in FIG. 14.
FIG. 16 is a top view of the apparatus as shown in FIG. 14.
FIG. 17 is an underneath perspective view of the apparatus as shown in FIG. 14.
FIG. 18 is an underneath plan view of the apparatus as shown in FIG. 17.
FIG. 19 is an end view of the apparatus as shown in FIG. 14.

The footrest 8 has roller means 14 as shown in FIGS. 13, 17 and 18. The roller means 14 allows the length of stretchable material 12 to connect to the footrest 8 such that the flat sides of the length of stretchable material 12 slide over the roller means 14.

Figure 4:
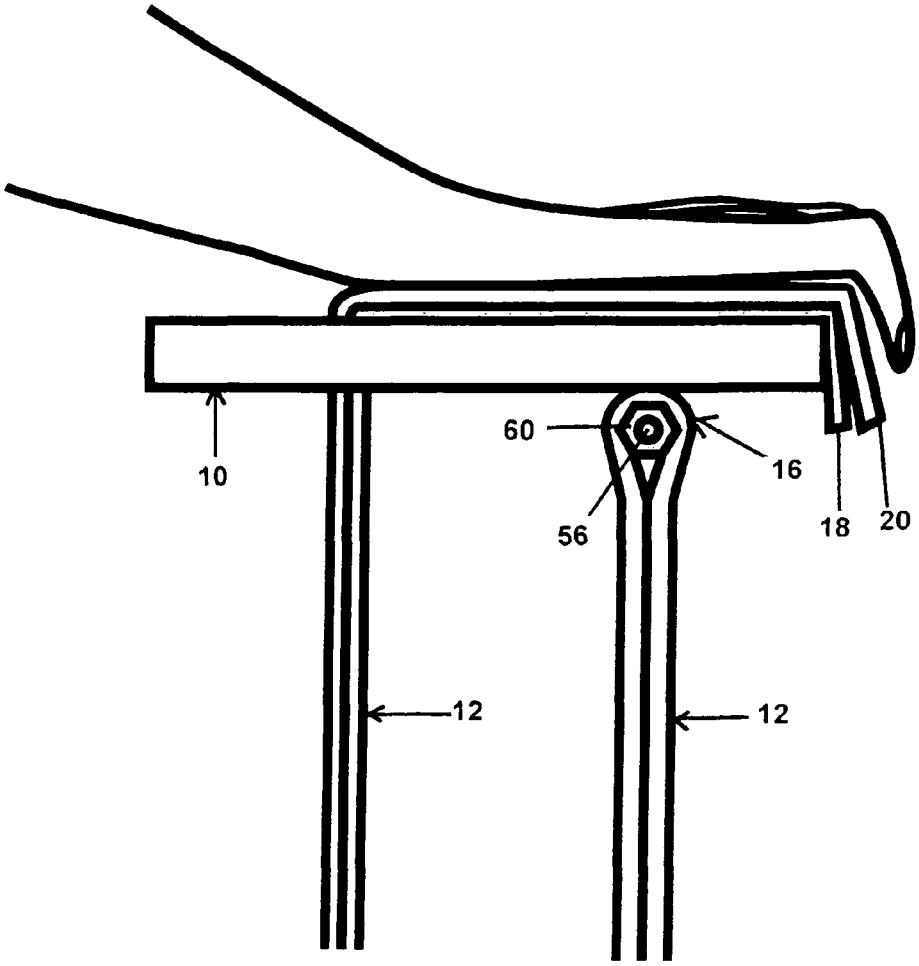
FIG. 4 is an enlarged side view of a kneerest part of the apparatus as used in FIG. 1.
Figure 5:
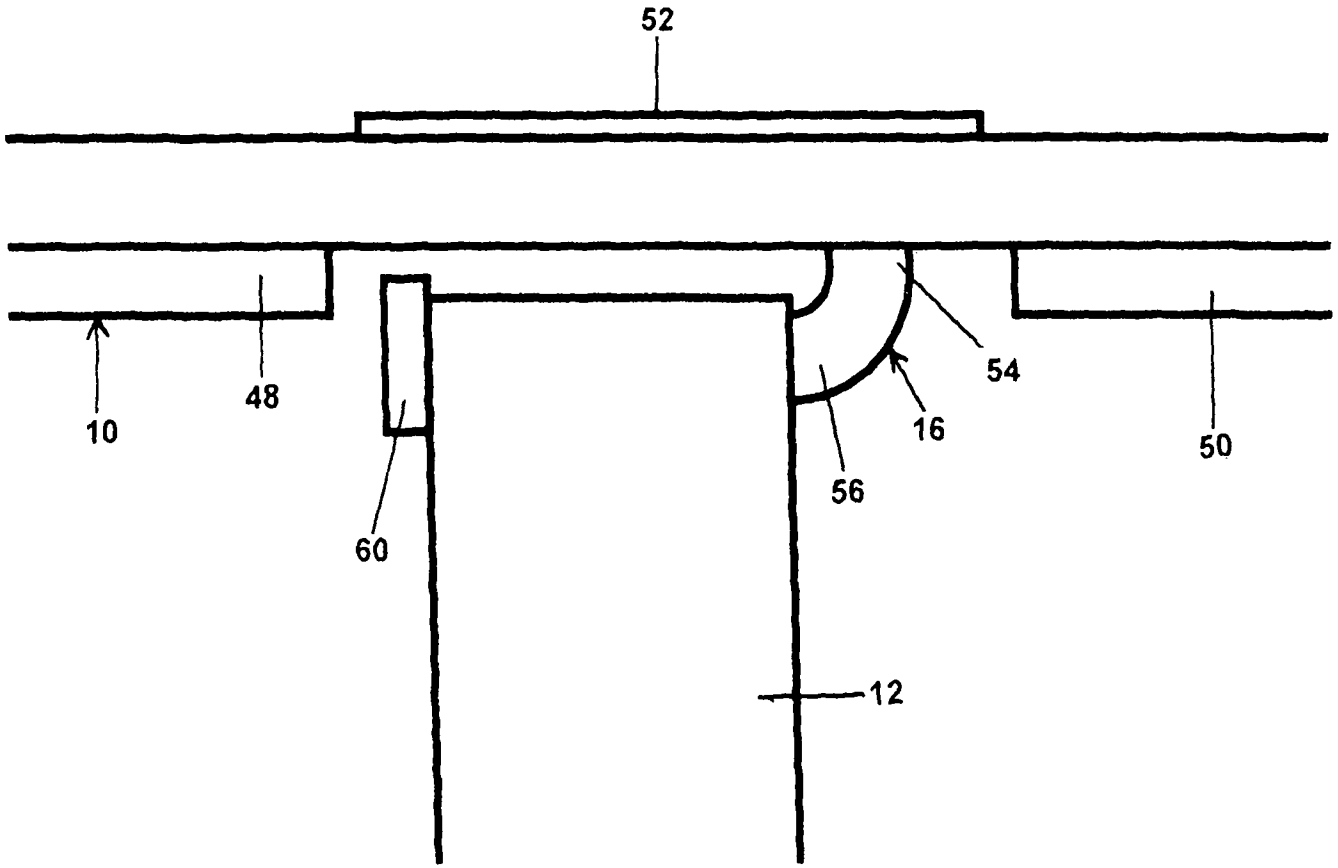
FIG. 5 is an enlarged front view of part of the kneerest shown in FIGS. 1 and 4.
Figure 6:
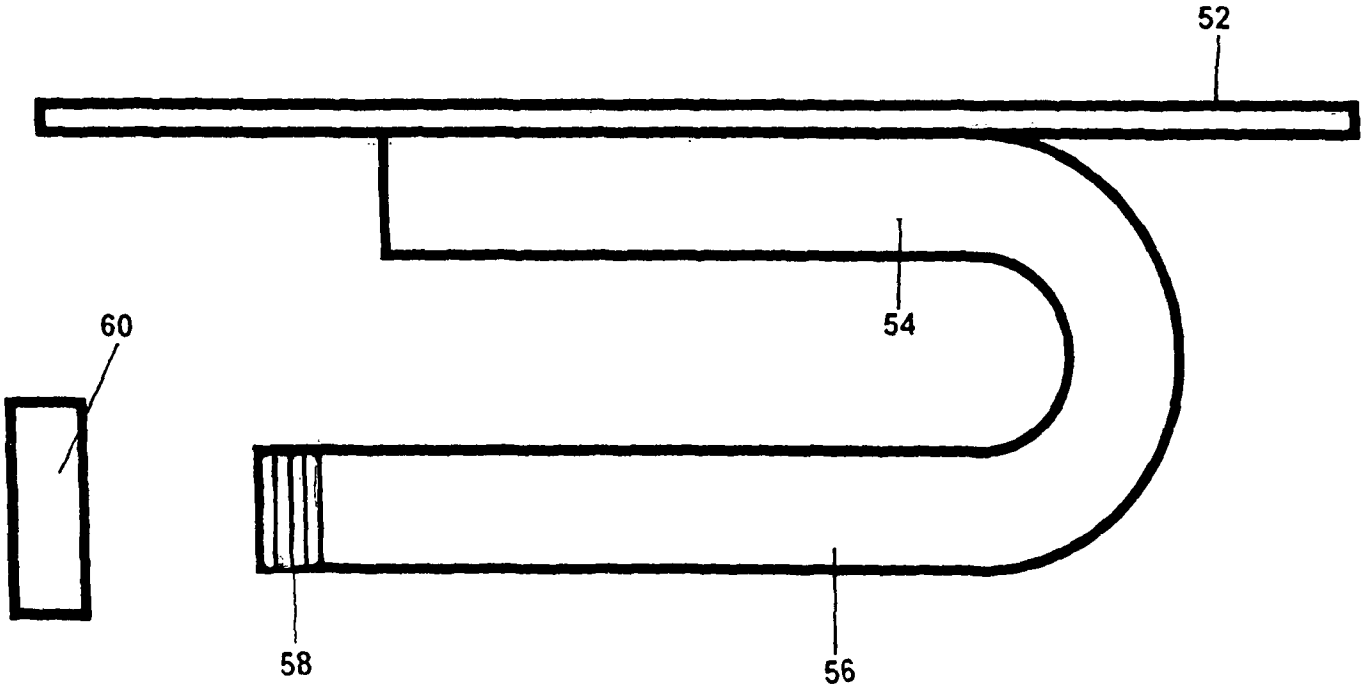
FIG. 6 is an exploded view of part of the apparatus as shown in FIG. 5 and illustrates the optional use of an abutment member.
Figure 8:
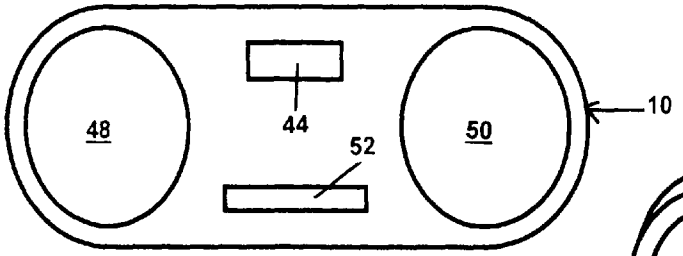
FIG. 8 is a top view of the kneerest as shown in FIG. 7.
Figure 7:
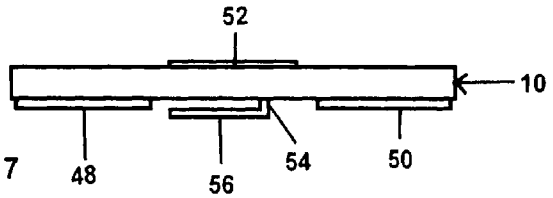
FIG. 7 is an end view of the kneerest shown in FIG. 1.
Figure 9:
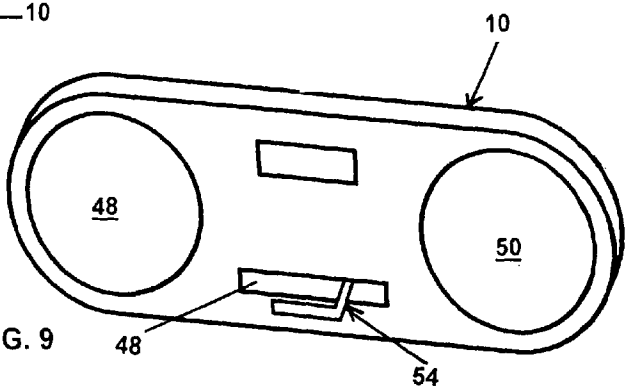
FIG. 9 is an underneath view of the kneerest as shown in FIG. 7.
Figure 10:
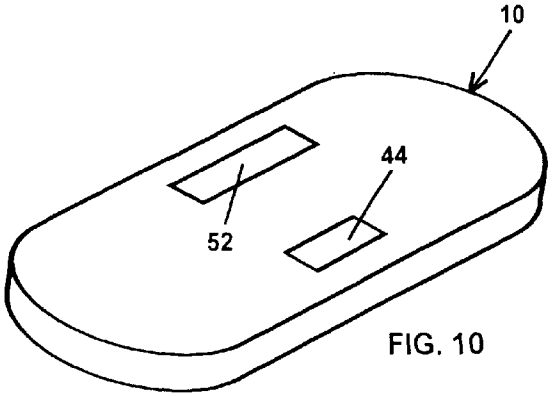
FIG. 10 is a top view of the kneerest as shown in FIG. 7.
Figure 11:
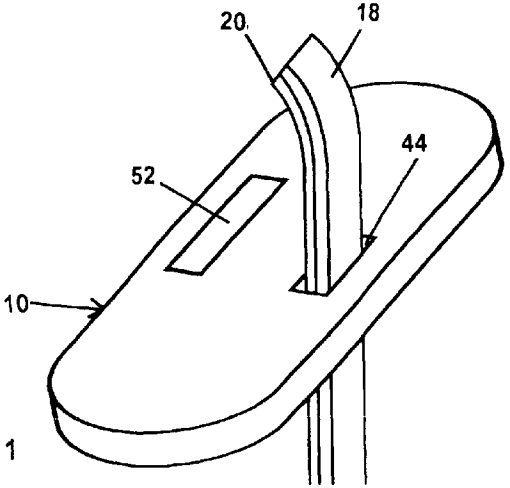
FIG. 11 shows the kneerest as shown in FIG. 10 and with a length of stretchable flexible material passing through an aperture in the kneerest.

The kneerest 10 has anchor means 16 for the length of stretchable material 12 as shown in FIGS. 4, 5 and 6. The anchor means 16 allows the length of stretchable material 12 to connect to the kneerest 10 such that the flat sides of the length of stretchable material 12 pass over the anchor means 16.

Figure 3:
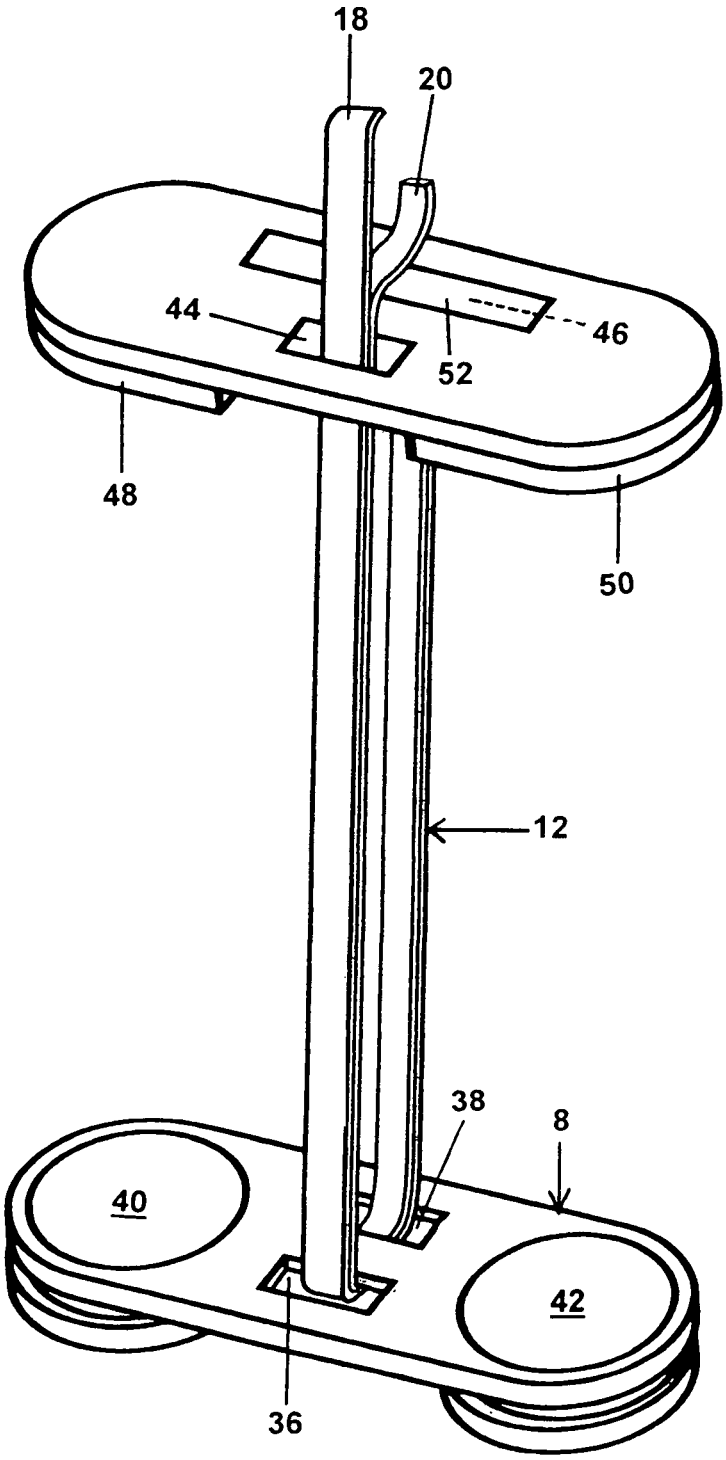
FIG. 3 is a perspective view of the apparatus in the form required for FIG. 1.

The length of stretchable material 12 has a first free-end 18 and a second free end 20 as best shown in FIG. 3.

The footrest 8, the kneerest 10, and the length of stretchable material 12 are separable from each other.

As can be appreciated from FIG. 1, the footrest 8, the kneerest 10, and the length of flexible material 12 are such that in use together and with the person 6 seated in a seated position on a seat 21, then the front part 22 of the person's feet 24 rest on the footrest 8 to retain the footrest 8 on the floor, and the kneerest 10 rests on the person's knees 26. The length of stretchable material 12 is stretched when the person 6 pivots the rear part 28 of their feet 24 upwardly with respect to the footrest 8. The length of stretchable material 12 contracts when the person 6 pivots the rear part 28 of their feet 24 downwardly with respect to the footrest 8. The stretching of the length of stretchable material 12 requires effort from the person's calves 4 which thereby exercises the person's calves with the person 6 being in the seat position as shown in FIG. 1. As the apparatus 2 is used in the seated position shown in FIG. 1, the person holds the length of stretchable material 12 as shown on the kneerest 10. The first and second free ends 18, 20 hang over the front edge of the kneerest 10 and it is easy for the person 6 to hold the length of stretchable material 12 in position on the kneerest 10 whilst the person 6 is exercising their calves 4.

Figure 2:
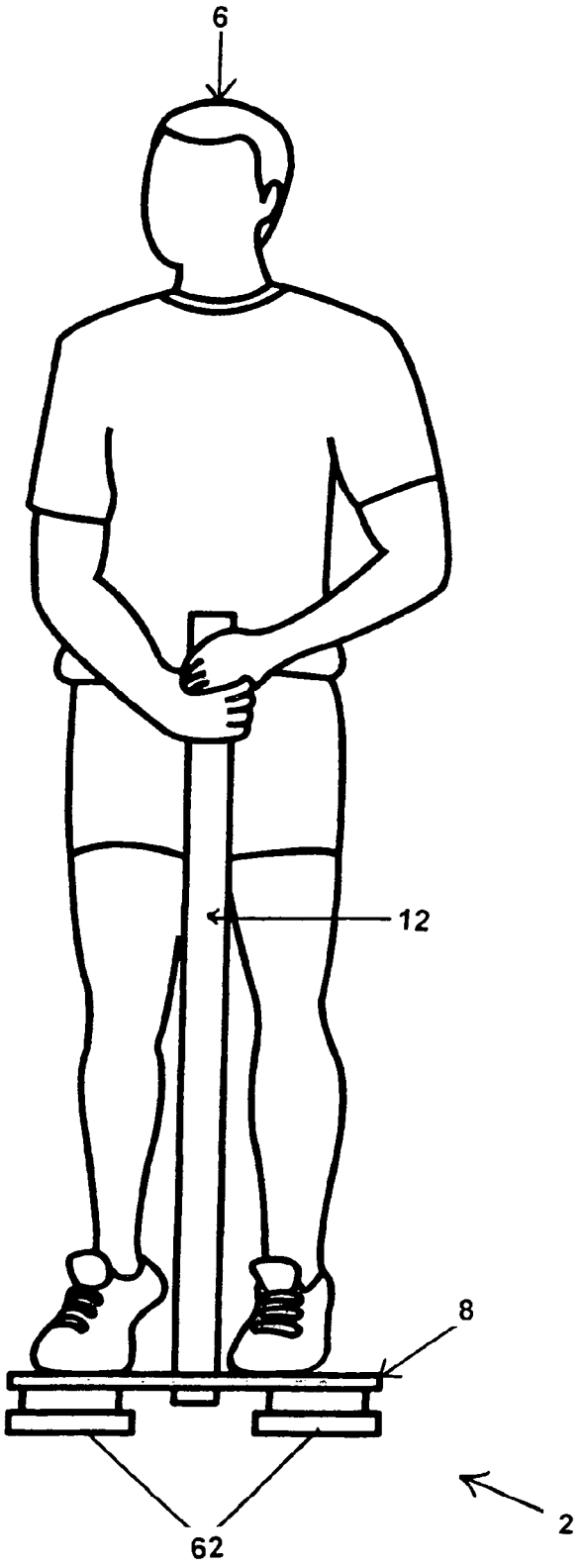
FIG. 2 shows the apparatus of FIG. 1 and being used to exercise a person's calves but with the person being in a standing position.

The footrest 8 and the length of stretchable material 12 are such that in use together and without the kneerest 10, they are able to be used with the person 6 being in a standing position as shown in FIG. 2. In this position, the person 6 holds the first and second free ends 18, 20 of the length of stretchable material 12. The front part of the person's feet 24 rest on the footrest 8 to retain the footrest 8 on the floor. The length of stretchable material 12 is stretched when the person 6 pivots the rear part 28 of their feet 24 upwardly with respect to the footrest 8. The stretching of the length of material 12 requires effort from the person's calves 4 which thereby exercises the person's calves 4.

As can best be appreciated from FIGS. 17 and 18, the roller means 14 is positioned on the underside 30 of the footrest 8. The roller means 14 is a pair of spaced apart rollers 32, 34. The rollers 32, 34 are shown in FIG. 17. In FIG. 18, the rollers 32, 34 have been omitted to show how the ends of the rollers 32, 34 are mounted grooves 35, 37. The ends of the rollers 32, 34 are a press fit into the grooves 35, 37 and, once in position, are freely rotatable in the grooves 35, 37. The rollers 32, 34 extend across an aperture 39 in a moulding 41.

As can best be appreciated from FIG. 3, the footrest 8 has a pair of spaced apart apertures 36, 38 for locating the length of stretchable material 12. The footrest 8 also has a pair of spaced apart foot pads 40, 42 for receiving the person's feet 24. The foot pads 40, 42 have a slip-resisting surface for preventing the person's feed 24 slipping off the footrest 8.

As can best be appreciated from FIGS. 3-11, the kneerest 10 has a pair of spaced apart apertures 44, 46. The aperture 46 is for locating the length of stretchable material 12. The kneerest 10 also comprises a pair of knee pads 48, 50 for providing comfort to the knees 26 of the person 6 when using the apparatus 2 in the seated position shown in FIG. 1.

The aperture 46 in the kneerest 10 is in the form of a slot. The slot receives the anchor means 16. More specifically, the anchor means 16 comprises a plate 52 which rests on top of the kneerest 10 and closes the aperture 46. A part 54 of the abutment means 16 is secured to the plate 52. The plate 52 is preferably made of metal and thus the part 54 can be welded to the underside of the plate 52. The part 54 extends into a rod portion 56 as shown in FIG. 5. The length of stretchable material 12 passes over the rod portion 56 during use of the apparatus 2 with the person 6 in the seated position as shown in FIG. 1.

In an optional embodiment of the invention, the anchor means 16 is such that the rod portion 56 has a threaded end 58 which receives an end abutment member in the form of a nut 60. As can be appreciated from FIGS. 5 and 6, the nut 60 stops any possibility of the length of stretchable material 12 sliding off the rod portion 56 during use of the apparatus 2 with the person 6 in the seated position as shown in FIG. 1.

Figure 12:
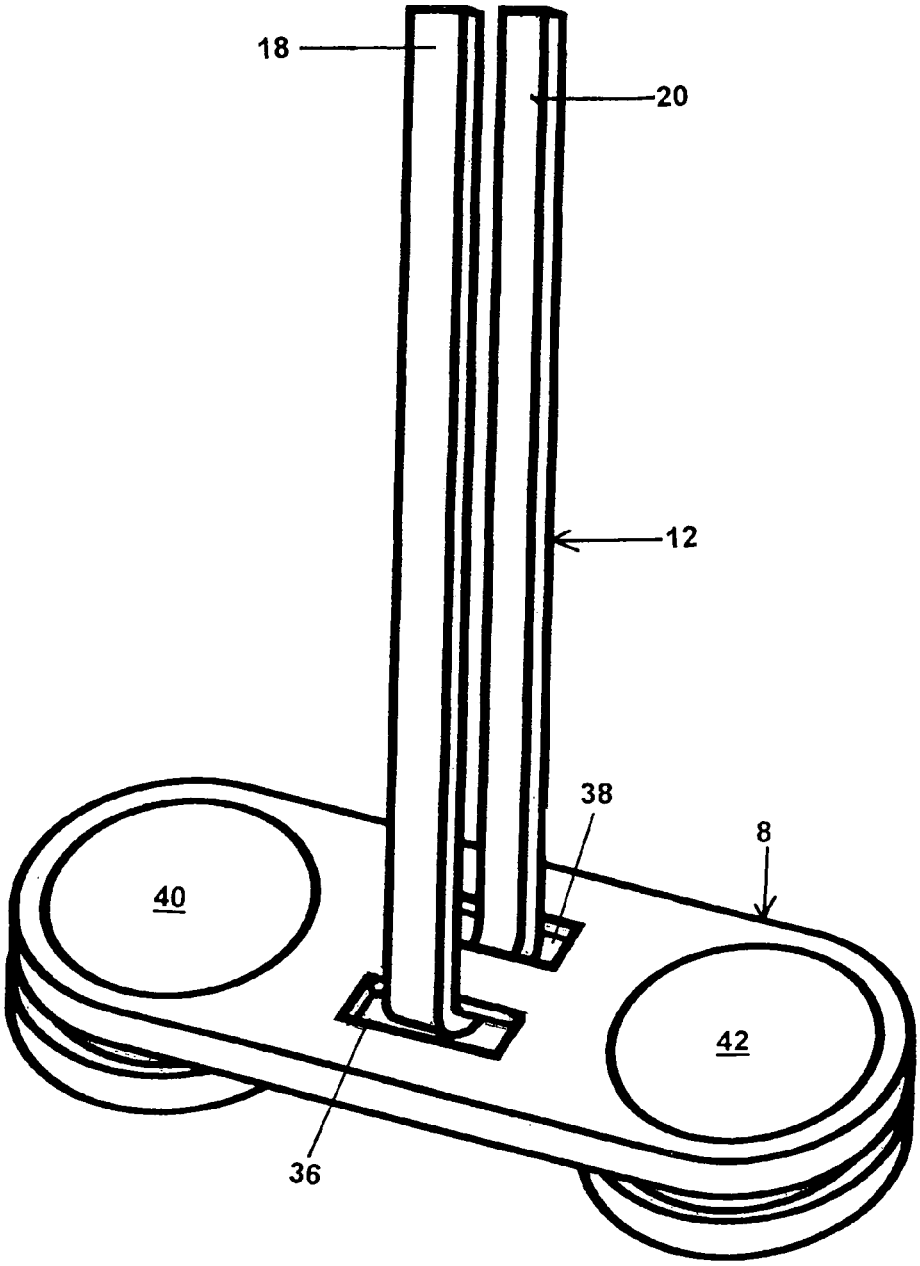
FIG. 12 shows the apparatus as used in FIG. 2.

As can be appreciated from FIGS. 2 and 12, the length of stretchable material 12 is folded in two when the apparatus 2 is used with the person 6 in the standing position. As can be appreciated from FIGS. 1 and 3, the length of stretchable material 12 is folded in four when the apparatus 2 is used with the person 6 in the seated position. The extra doubling of the length of stretchable material 12 from the folded arrangement shown in FIG. 12 to the folded arrangement shown in FIG. 3 provides a doubling of the resistance provided by the length of stretchable material 12. This in turn provides a doubling of the effort required to exercise the person's calves 4. In the folded arrangement shown in FIG. 3, pulling of the first and second free ends 18, 20 further through the aperture 44 increases the effort required from the person's calves. Similarly pulling up on the length of stretchable material by gripping the length of stretchable material below the first and second free ends as shown in FIG. 2 increases the effort from the person's calves.

The apparatus 2 of the present invention is very easily and advantageously altered from the arrangement shown in FIGS. 1 and 3 with the arrangement shown in FIGS. 2 and 12. It is simply necessary to remove the kneerest 10. This simplicity of changeability between the two modes of use of the apparatus 2 encourages the person 6 to exercise their calves in two different ways, and thereby gain maximum development of their calves 4 from use of the apparatus 2. In addition, the apparatus 2 is easily dismantled into the separate parts of the footrest 8, the kneerest 10, and the length of stretchable material 12. This enables the apparatus 2 easily to be stored away when it is not in use. Equally easily, the apparatus can be taken from storage and assembled ready for use. Still further, the apparatus 2 is advantageous in that it is simply constructed, which minimises cost of manufacture. The apparatus 2 is able to be made of metals and plastics materials and is able to be very much lighter than machines as found in gymnasiums. This in turn enables the apparatus 2 to be sold by Mail Order if desired.

Figure 20:
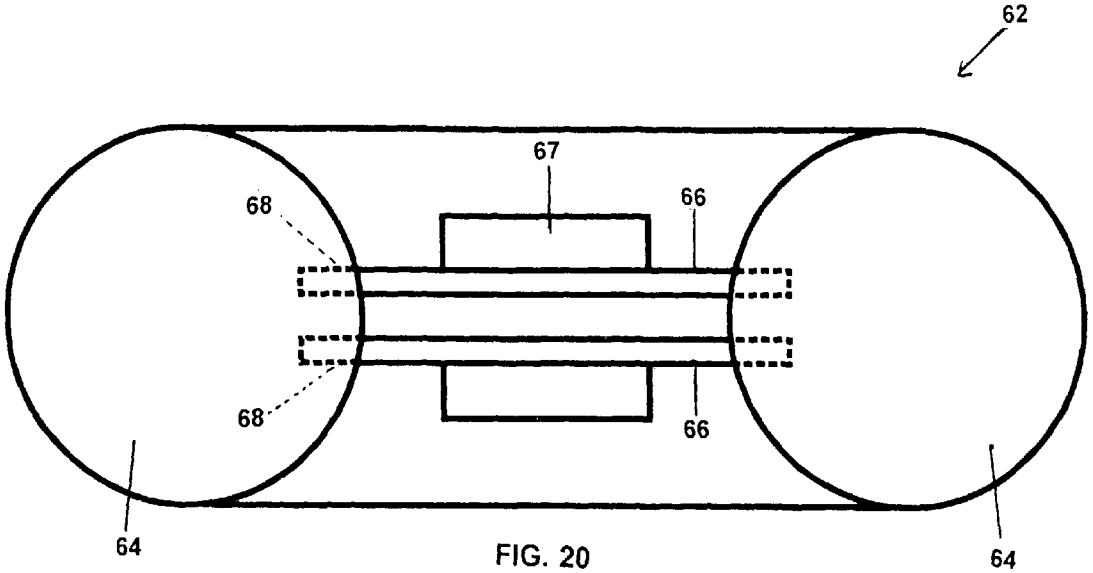
FIG. 20 is an underneath plan view of an alternative footrest able to be used in the apparatus of the present invention.
Figure 21:
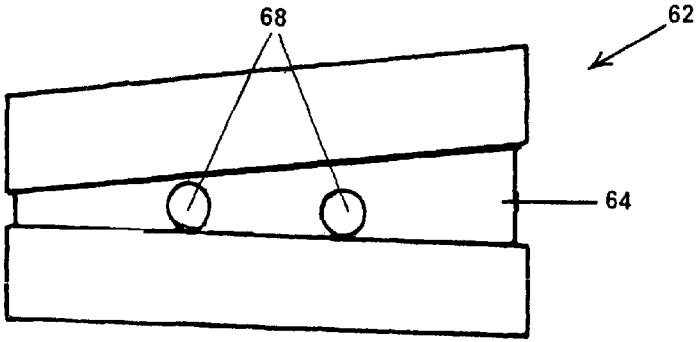
FIG. 21 is a side view of the footrest as shown in FIG. 20.
Figure 22:
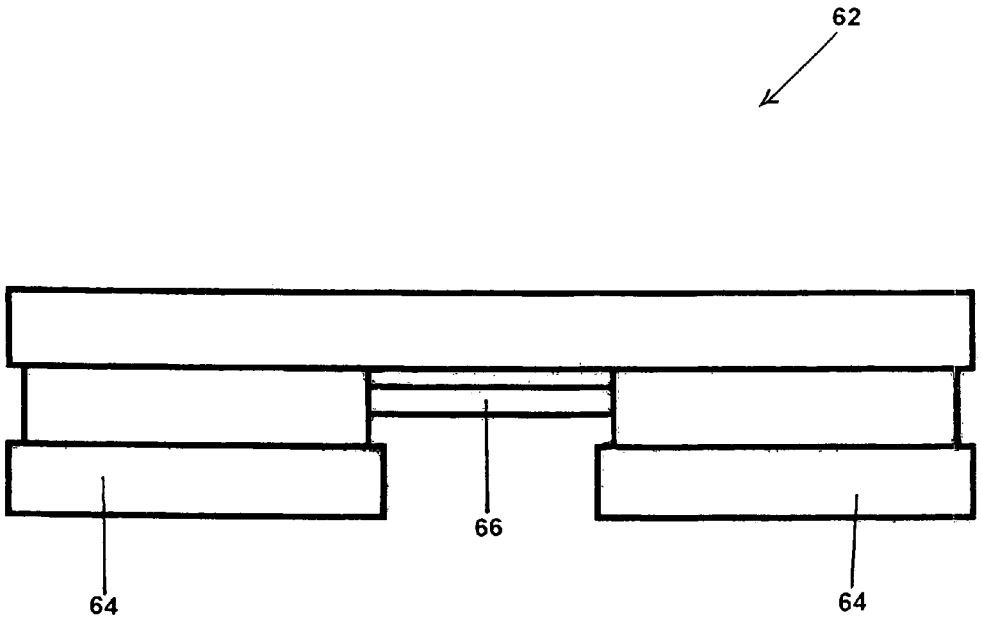
FIG. 22 is a front view of the footrest as shown in FIG. 20.

Referring now to FIGS. 20, 21 and 22 there is shown a footrest 62 comprising legs 64 and metal roller rods 66. An aperture 67 in the footrest 62 is for the length of stretchable material which may be regarded as a resistance band. The legs 64 have holes 68 for receiving the metal roller rods 66. The location of the metal roller rods 66 in the holes 68 of the legs 64 is an alternative to locating the metal roller rods 66 in a separate support member positioned between the legs as shown in FIGS. 17 and 18. The length of stretchable material passes around the metal roller rods 66 as will be appreciated from FIG. 13 and its rollers 32, 34.

Referring now to FIGS. 23-29, there is shown further apparatus 70 of the present invention. Similar parts as in previous Figures have been given the same reference numerals for ease of comparison and understanding.

Figure 23:
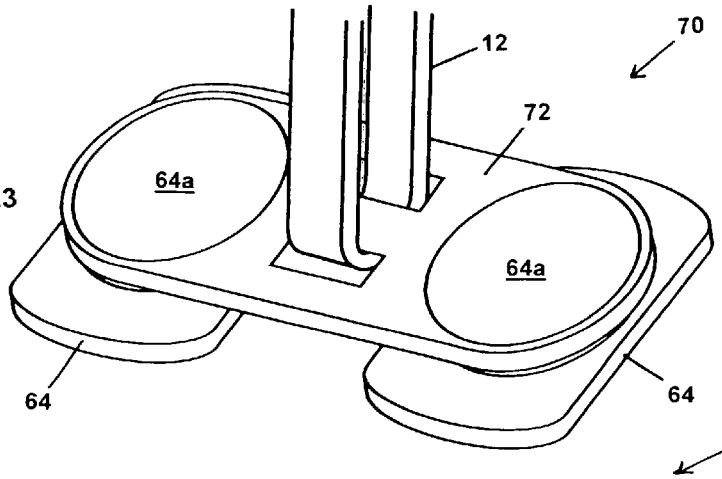
FIG. 23 shows further apparatus of the present invention.
Figure 25:
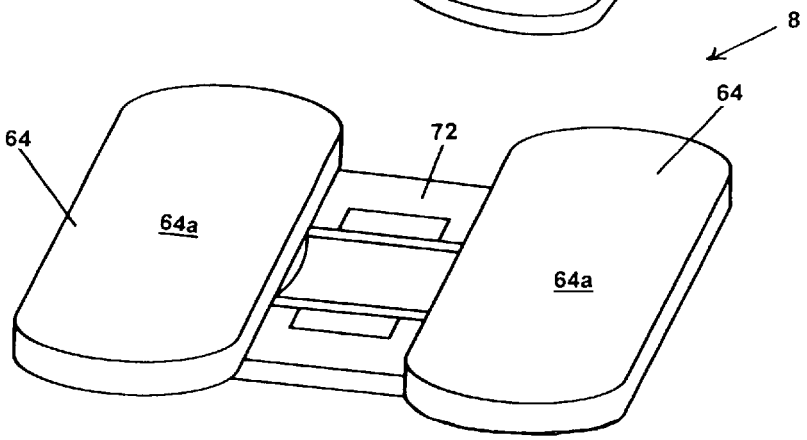
FIG. 25 is an underneath view of the part of the apparatus as shown in FIG. 23.

As can be seen from FIGS. 23 and 25, the legs 64 are elliptical whereas the legs 64 in FIG. 20 are circular. The elliptical legs may give slightly more stability to the apparatus during use.

Figure 24:
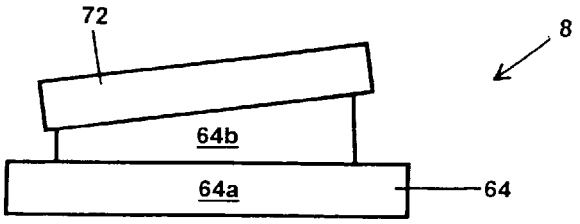
FIG. 24 is an end view of part of the apparatus as shown in FIG. 23.

As can best be appreciated from FIG. 24, the legs 64 may be moulded in two parts, with the two parts being an elliptical base portion 64*a* and an upper inclined portion 64*b*. The two parts 64*a*, 64*b* may then be secured together, for example by bolts or an adhesive.

Figure 26:
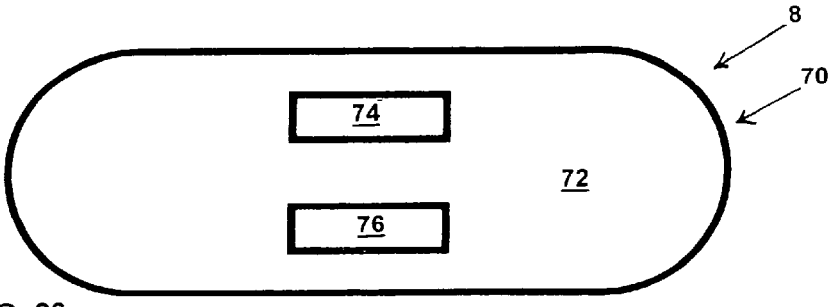
FIG. 26 shows part of the apparatus as shown in FIG. 24.
Figure 27:
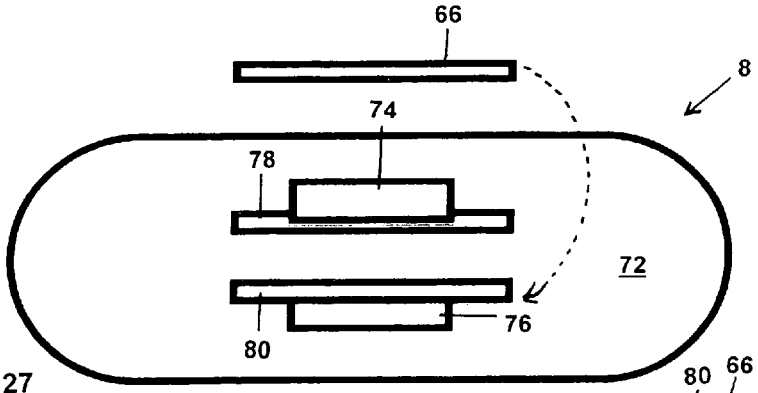
FIG. 27 illustrates how the part of the apparatus shown in FIG. 24 is assembled.

FIG. 26 illustrates how a platform part 72 is provided with a pair of slots 74, 76. FIG. 27 illustrates how the platform part 72 is also provided with a pair of grooves 78, 80. FIG. 27 also illustrates how the metal roller rod 66 is able to be inserted in its groove 80. In FIG. 27, the groove 78 is shown for comparative purposes without its metal roller rods 66.

Figure 28:
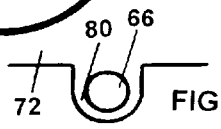
FIG. 28 shows one roller rod located in a groove.

FIG. 28 is an end view showing the metal roller rods 66 in its groove 80.

Figure 29:
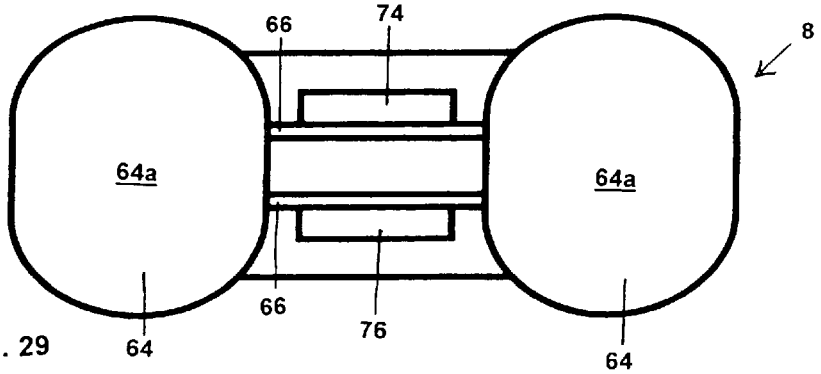
FIG. 29 is a view like FIG. 25 and shows the assembled part of the apparatus.

FIG. 29 is an underneath view like FIG. 25 and shows the metal roller rods 66 in position, with the legs 64 having then been placed on the underneath of the platform part 72, and thereby to form the apparatus 70 as shown in FIG. 23.

As shown in FIG. 27 at the top, the groove overlaps the slots 74.

Referring to FIG. 24, the parts 64*a*, 64*b* and 72 may be bolted together. When the parts 64*a* are in position, they hold the ends of the metal roller rods 66 in position in their grooves 78, 80.

It is to be appreciated that the embodiments of the invention described above with reference to the accompanying drawings have been given by way of example only and that modifications may be effected. Thus, for example, the footrest 8 is shown having an inclined upper surface. The inclined upper surface of the footrest 8 is preferred to maximise the calf workout in the seated position shown in FIG. 1. If desired however the footrest 8 could have a flat surface for the person's feet 24. Other types of roller means 14 and other types of anchor means 16 may be employed. Similarly, other types of foot pads 40, 42 and knee pads 48, 50 may be employed. The apparatus may be used with more than one of the lengths of stretchable material in both the sitting and standing use positions. The footrest 8 has two feet 62 and these may be larger or smaller than shown. Individual components shown in the drawings are not limited to use in their drawings and they may be used in other drawings and in all aspects of the invention.

The invention claimed is:

1. An apparatus for exercising a person's calves in two different ways, the apparatus comprising a footrest, a kneerest, and a length of stretchable material for extending between the footrest and the kneerest, wherein:

(i) the length of stretchable material is flat sided;

(ii) the footrest has a roller arrangement;

(iii) the roller arrangement allows the length of stretchable material to connect to the footrest wherein flat sides of the length of stretchable material slide over the roller arrangement;

(iv) the kneerest has an anchor means for the length of stretchable material;

(v) the anchor means allows the length of stretchable material to connect to the kneerest wherein the flat sides of the length of stretchable material pass over the anchor means;

(vi) the anchor means comprises a rod portion which extends parallel to the knee rest, the rod portion being spaced a vertical distance apart from and below the knee rest, the length of stretchable material passing around the rod portion along a longitudinal axis of the length of stretchable material during use of the apparatus with the person in a seated position;

(vii) the length of stretchable material has a first free end and a second free end;

(viii) the footrest, the kneerest, and the length of stretchable material are separable from each other;

(ix) the footrest, the kneerest and the length of stretchable material are configurable wherein in use together and with the person seated in the seated position, the first and second free ends are adapted to be held over an upper face of the kneerest in order to secure the first and second free ends with respect to the kneerest;

(x) the footrest, the kneerest and the length of stretchable material are configurable wherein in use together and with the person seated in the seated position, the first and second free ends are adapted to be held on the upper face of the kneerest, the footrest is adapted to be retained on a floor by a front part of the person's feet resting on the footrest, the kneerest is adapted to rest on the person's knees, the length of stretchable material is adapted to be stretched when the person pivots a rear part of their feet upwardly with respect to the footrest, the length of stretchable material is adapted to contract when the person pivots the rear part of their feet downwardly with respect to the footrest, and the stretching of the length of stretchable material is adapted to require effort from the person's calves thereby exercising the person's calves with the person being in the seated position; and (xi) the footrest and the length of stretchable material are configurable wherein in use together and without the kneerest and with the person in a standing position, the first and second free ends are adapted to be held by the person in the standing position, the footrest is adapted to be retained on the floor by the front part of the person's feet resting on the footrest, the length of the stretchable material is adapted to be stretched when the person pivots the rear part of their feet upwardly with respect to the footrest, and the stretching of the length of stretchable material is adapted to require the effort from the person's calves thereby exercising the person's calves with the person being in the standing position.

2. The apparatus according to claim 1 wherein the roller arrangement is positioned on an underside of the footrest.

3. The apparatus according to claim 1 wherein the roller arrangement is a pair of spaced apart rollers.

4. The apparatus according to claim 1 wherein the footrest has a pair of spaced apart apertures for locating the length of stretchable material.

5. The apparatus according to claim 1 wherein the footrest has a pair of spaced apart recesses for locating the length of stretchable material.

6. The apparatus according to claim 1 wherein the footrest has a pair of spaced apart footpads adapted for receiving the person's feet, and wherein the pair of spaced apart footpads have a slip-resisting surface adapted for preventing the person's feet from slipping off the footrest.

7. The apparatus according to claim 1 wherein the kneerest has an aperture for locating the length of stretchable material.

8. The apparatus according to claim 1 wherein the kneerest comprises a pair of kneepads adapted for providing comfort to the knees of the person when using the apparatus in the seated position.

9. The apparatus according to claim 1 wherein the anchor means comprises an end abutment member for use in preventing the length of stretchable material from slipping off the apparatus during use of the apparatus with the person in the seated position.

10. The apparatus according to claim 1 wherein the length of stretchable material is of a length wherein it is configured to be folded in two when the apparatus is used with the person in the standing position, and is configured to be folded in four when the apparatus is used with the person in the seated position.

11. The apparatus according to claim 1 and including a plurality of the lengths of stretchable material adapted for increasing the required effort from the person's calves.

12. The apparatus according to claim 1 wherein the rod portion extends from a plate, and wherein the plate is located in a slot in the kneerest.

13. The apparatus according to claim 12 wherein the rod portion comprises an end abutment member for use in preventing the length of stretchable material from slipping off the apparatus during use of the apparatus with the person in the seated position.

* * * * *